US010110985B2

(12) United States Patent
Meyer

(10) Patent No.: US 10,110,985 B2
(45) Date of Patent: Oct. 23, 2018

(54) EARPHONE WITH CHANNEL FOR CORD MANAGEMENT

(71) Applicant: Harman International Industries, Inc., Stamford, CT (US)

(72) Inventor: Anna Grace Meyer, Saint Louis, MO (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/194,660

(22) Filed: Jun. 28, 2016

(65) Prior Publication Data

US 2016/0381449 A1 Dec. 29, 2016

Related U.S. Application Data

(60) Provisional application No. 62/185,873, filed on Jun. 29, 2015.

(51) Int. Cl.
*H04R 1/10* (2006.01)

(52) U.S. Cl.
CPC ..... *H04R 1/1033* (2013.01); *H04R 1/1016* (2013.01); *H04R 1/1066* (2013.01); *H04R 2201/10* (2013.01); *H04R 2201/105* (2013.01)

(58) Field of Classification Search
CPC .. H04R 1/1033; H04R 1/1016; H04R 1/1066; H04R 2201/10; H04R 2201/105; H04M 1/15
See application file for complete search history.

(56) References Cited

U.S. PATENT DOCUMENTS

| | | | | |
|---|---|---|---|---|
| 5,845,197 | A | 12/1998 | Hada et al. | |
| 2009/0238395 | A1* | 9/2009 | Jubelirer | H04R 1/08 381/370 |
| 2011/0044487 | A1* | 2/2011 | Nault | H04R 1/1033 381/380 |
| 2015/0131839 | A1* | 5/2015 | Blonder | H04R 1/1033 381/384 |

FOREIGN PATENT DOCUMENTS

| | | | |
|---|---|---|---|
| DE | 102004057283 | A1 | 4/2006 |
| JP | S6374894 | U | 5/1988 |
| JP | 2003324784 | A | 11/2003 |
| JP | 2005252579 | A | 9/2005 |
| JP | 2011139435 | A | 7/2011 |

OTHER PUBLICATIONS

European Search Report for Application No. 16176412.1, dated Nov. 25, 2016, 9 pages.

* cited by examiner

*Primary Examiner* — Joshua Kaufman
(74) *Attorney, Agent, or Firm* — Brooks Kushman P.C.

(57) ABSTRACT

An earphone includes a housing arranged to receive a speaker, the housing having a front portion arranged to be inserted in a user's ear and a rear portion arranged to remain outside the user's ear. The rear portion has a channel formed therein which is sized to receive an earphone cord and secure it therein. The earphone may also include an earphone plug having a plug housing with a channel formed therein or a cord joint having a joint housing with a channel formed therein.

18 Claims, 5 Drawing Sheets

EARPHONE WITH CHANNEL FOR CORD MANAGEMENT

CROSS-REFERENCE TO RELATED APPLICATIONS

This application claims the benefit of U.S. provisional application Ser. No. 62/185,873 filed Jun. 29, 2015, the disclosure of which is hereby incorporated in its entirety by reference herein.

TECHNICAL FIELD

Embodiments relate to an earphone with at least one channel for receiving an earphone cord.

BACKGROUND

Individuals use earphones or earbuds for a variety of audio applications. Since earphones block surrounding sounds, for safety reasons or in other situations when a user needs to be aware of the external environment, the user may wish to only use one of the two earphones. When removed from the ear, the unused earphone dangles freely and has a tendency to get in the way, creating an annoyance. The cords of the used and unused earphones may also tangle. Furthermore, when a user attempts to store their earphones by wrapping them, there is no way to secure the cords from unraveling and tangling.

SUMMARY

In one embodiment, an earphone is provided including a housing arranged to receive a speaker, the housing having a front portion arranged to be inserted in a user's ear and a rear portion arranged to remain outside the user's ear. The rear portion has a channel formed therein which is sized to receive an earphone cord and secure it therein.

In another embodiment, a pair of earphones is provided including a first housing and a second housing each arranged to receive a speaker, each of the first and second housings having a front portion arranged to be inserted in the user's ear and a rear portion which remains outside the user's ear. The earphones further include a first earphone cord and a second earphone cord each having a first end extending from the first housing and the second housing, respectively. An earphone plug receives a second end of each of the first and second earphone cords, the earphone plug having a plug housing with a channel formed therein which is sized to receive one of the first and second earphone cords and secure it therein.

In another embodiment, a pair of earphones is provided including a first housing and a second housing each arranged to receive a speaker therein, each of the first and second housings having a front portion arranged to be inserted in a user's ear and a rear portion arranged to remain outside the user's ear. The earphones further include a first earphone cord and a second earphone cord extending from the first housing and the second housing, respectively. A cord joint receives the first and second earphone cords, the cord joint having a joint housing with a channel formed therein which is sized to receive one of the first and second earphone cords and secure it therein.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
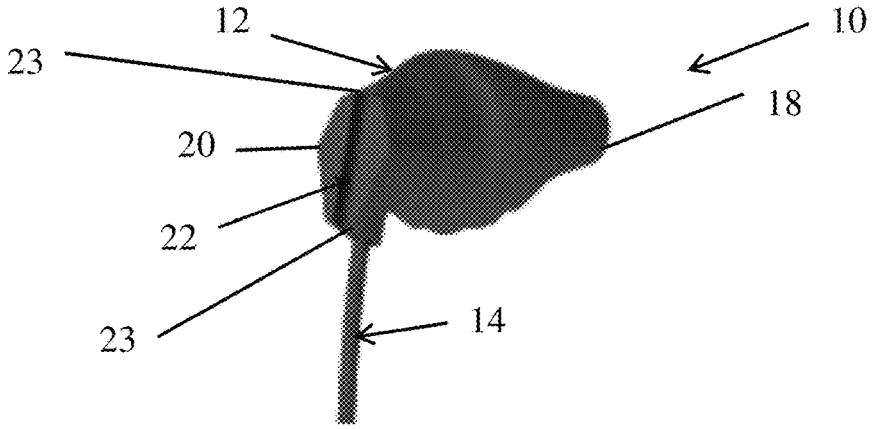
FIG. 1 is a perspective view of an earphone according to an embodiment.
Figure 2:
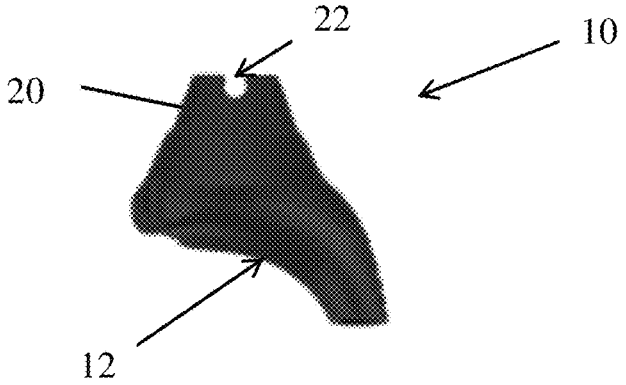
FIG. 2 is a top view of the earphone.

With reference to FIGS. 1 and 2, an earphone 10 is illustrated according to an embodiment. The earphone 10 includes a housing 12 in which a speaker (not shown) is disposed for transmitting sound to a user's ear. A cord 14 extends from the housing 12 to an earphone plug 16 for providing electrical communication between the speaker and the earphone plug 16 (see FIG. 5). The housing 12 has a front portion 18 which is arranged to be inserted in a user's ear and from which sound is directed into the ear, and a rear portion 20 which is arranged to remain outside a user's ear.

Figure 3:
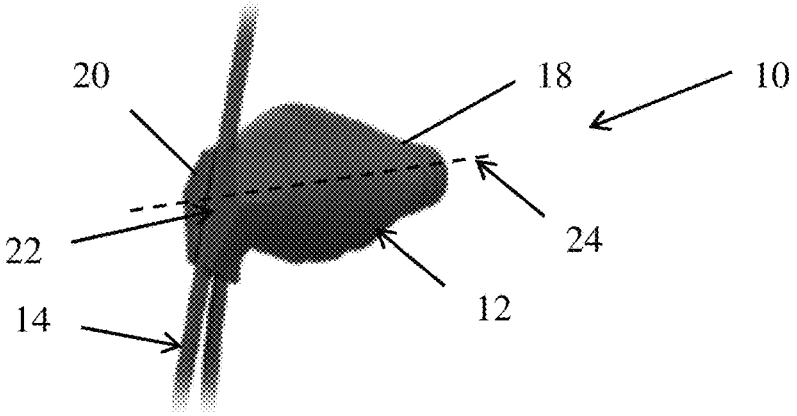
FIG. 3 is a perspective view of the earphone with a cord received within a channel formed in the earphone housing.
Figure 4:
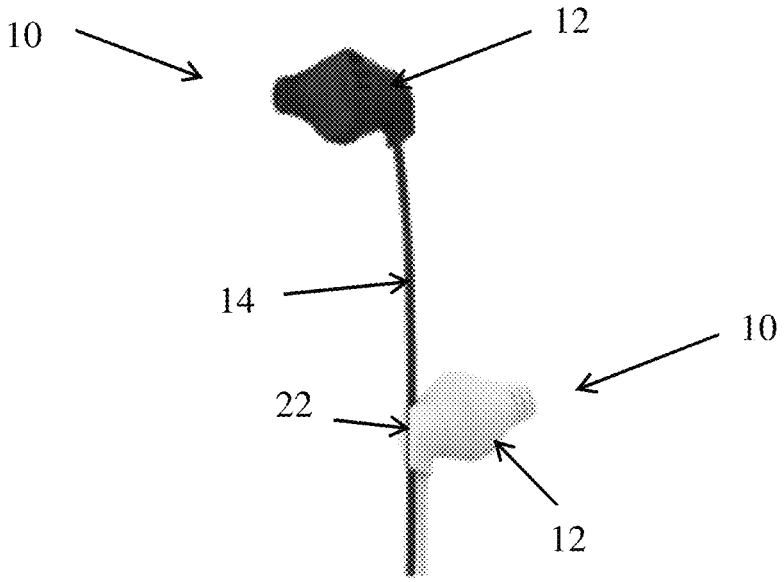
FIG. 4 is a perspective view of a cord from a first earphone received within the channel of a second earphone housing.

A channel 22, or cord pinch, is provided in the rear portion 20. As shown in FIGS. 3 and 4, the channel 22 is sized to receive an earphone cord 14 and secure it therein, such as via an interference fit. The user may press the earphone cord 14 into the channel 22 to secure it in place, such that, for example, when a user wishes to use only one earphone, the user can easily pinch one earphone 12 onto the cord 14 of the other earphone 12. In the embodiment depicted herein, the rear portion 20 has a hexagonal shape, and the rear portion 20 may have an angled or beveled configuration adjacent at least one end 23 of the channel 22, such as for facilitating insertion and removal of the cord 14. The channel may be oriented generally perpendicular to a horizontal axis 24 of the front portion 18, and the channel 22 may have a generally circular cross-section. However, it is understood that the rear portion 20 may have any configuration and the channel 22 may have any length, orientation and cross-section suitable for the intended application. Additional mechanisms of securing the earphone cord 14 to the housing 12 are also contemplated such as, but not limited to, a mechanical arm on the rear portion 20. Securing one or both earphones 12 to earphone cords 14 may also aide cord-wrapping for storage, as described further below.

Figure 5:
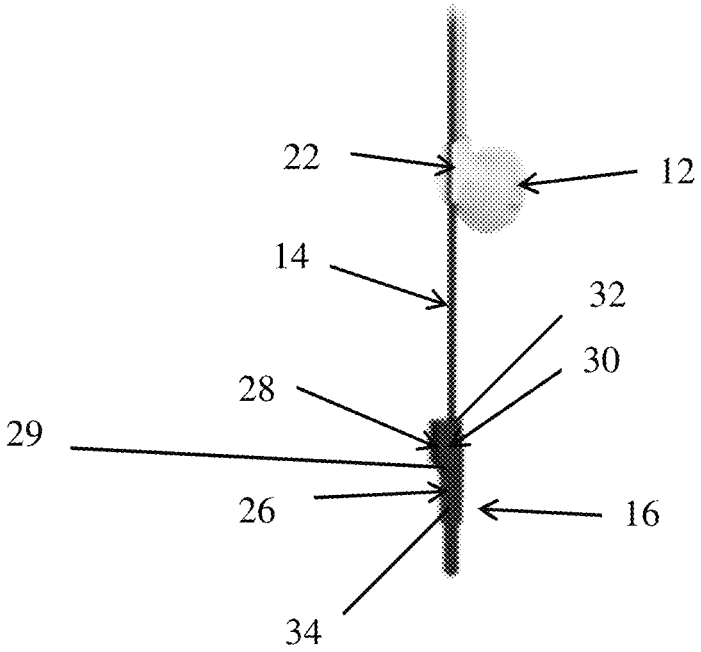
FIG. 5 is a perspective view of an earphone cord received within the channel of an earphone housing adjacent the earphone plug.

FIG. 5 illustrates an earphone plug 16 having a plug housing 26 with a channel 28 formed therein and sized to receive an earphone cord 14 and secure it therein, such as via an interference fit. In one embodiment, the channel 28 is formed in a protruding portion 30 of the plug housing 26. More particularly, the plug housing 26 may have an elongated shape, such as with a generally circular or square cross-section. The protruding portion 30 may be configured as an upper portion 32 of the plug housing 26, and may have a larger cross-sectional area than a lower portion 34 of the plug housing 26. The plug housing 26 may have an angled or beveled configuration adjacent at least one end 29 of the channel 22, such as for facilitating insertion and removal of the cord 14. The channel 28 may have an orientation generally parallel to the earphone cord 14 received at the earphone plug 16, and may have a generally circular cross-section. However, it is understood that the plug housing 26 and protruding portion 30 may have any configuration and the channel 28 may have any length, orientation and cross-section suitable for the intended application. The description of earphone channel 22 is also applicable to plug channel 28.

Figure 6:
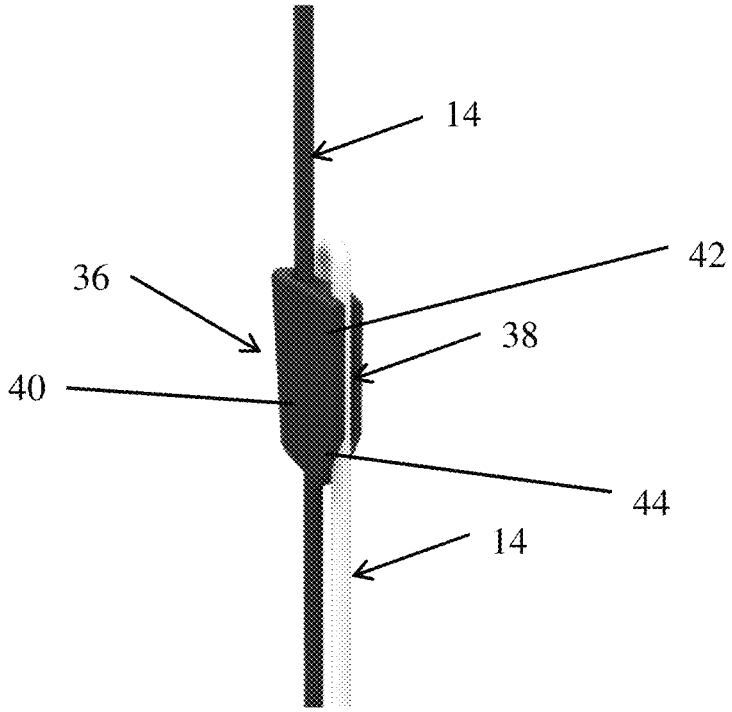
FIG. 6 is a perspective view of an earphone cord received within the channel of a cord joint.

As shown in FIG. 6, the cord joint 36, or V-stop, may also include a channel 38 provided in the joint housing 40 which sized to receive an earphone cord 14 and secure it therein, such as via an interference fit. More particularly, the joint housing 40 may have an elongated shape, such as with a generally rectangular cross-section, and the channel 38 may be formed in a side portion 42 of the housing 40 adjacent where the earphone cords 14 are received. The side portion 42 may have an angled or beveled configuration adjacent at least one end 44 of the channel 38, such as for facilitating insertion and removal of the cord 14. The channel 38 may have an orientation generally parallel to the earphone cord 14 received at the cord joint 36, and may have a generally circular cross-section. However, it is understood that the joint housing 40 and side portion 42 may have any configuration and the channel 38 may have any length, orientation and cross-section suitable for the intended application. The description of earphone channel 18 and plug channel 28 is also applicable to channel 38.

Figure 7A:
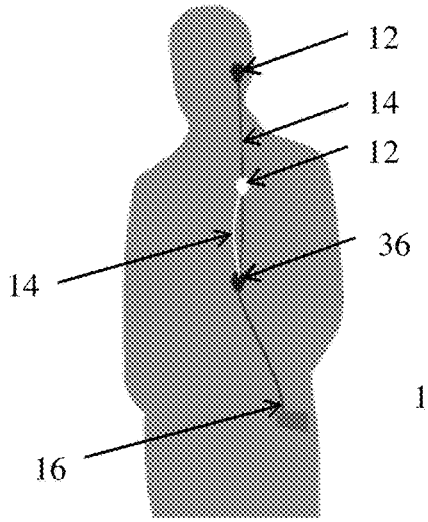
FIGS. 7A and 7B illustrate examples of an earphone housing secured to an earphone cord upward and downward from the cord joint, respectively.
Figure 7B:
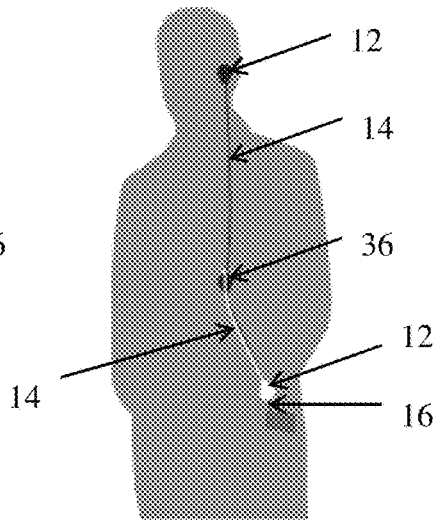

When a user wishes to use only one earphone 10, the user may secure the second, un-used earphone housing 12 to the earphone cord 14 of the earphone 10 in use, as illustrated in FIG. 7A. This location for the un-used earphone 10 may be desirable when the user only wishes to discontinue use of the second earphone 10 for a short period of time, as the second earphone 10 will be readily accessible when both earphones 10 are to be used again. Should a user wish to discontinue use of the second earphone 10 for an extended period of time, the storage configuration shown in FIG. 7B may be advantageous, where the second earphone housing 12 may be secured to the cord 14 adjacent the earphone plug 16. In this latter configuration, the cord 14 of the second earphone 10 may also be received within a channel 38 provided on the cord joint 36.

Figure 8:
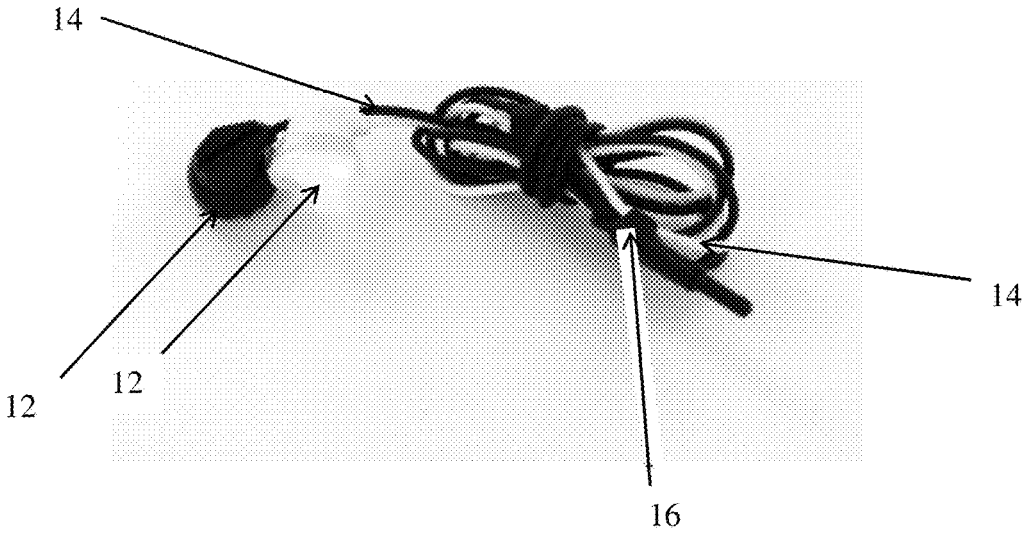
FIG. 8 is an illustration of an earphone cord received within the channel of an earphone plug, such as to allow for storage when not in use.
Figure 9:
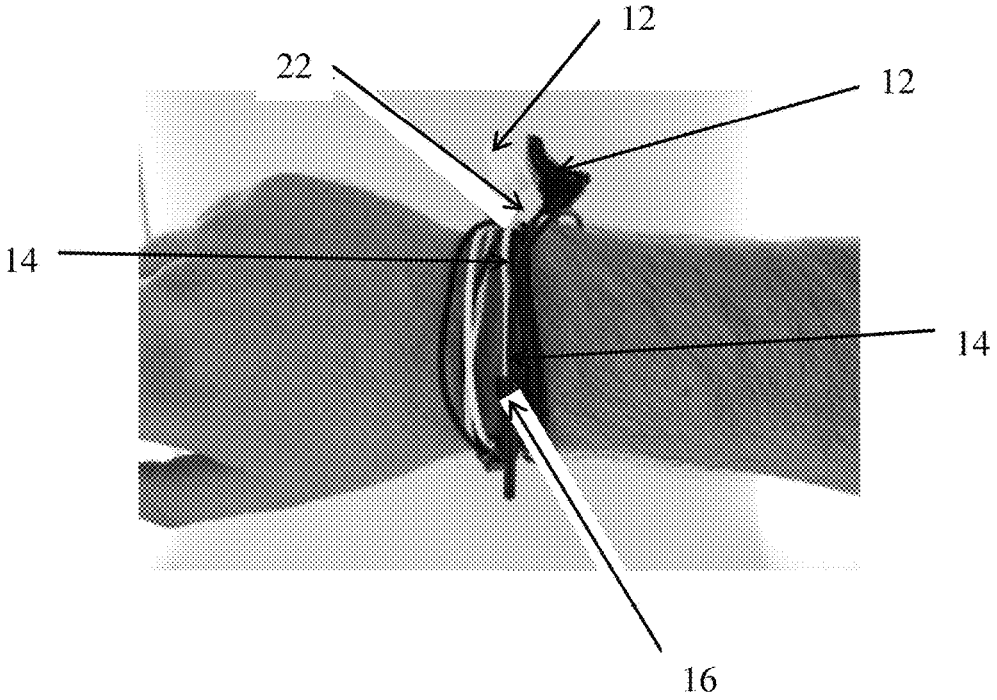
FIG. 9 is an illustration of an earphone cord received within the channel of an earphone housing and within the channel of an earphone plug, such as to allow for wrapping of the cord around a user's wrist.

FIG. 8 depicts an earphone cord 14 received within the channel 28 of an earphone plug 16, such as to allow for storage when not in use. As shown, a portion of the cord 14 may be wrapped around the remaining cords 14, and then the unwrapped cord 14 may be secured within the plug channel 28 to prevent unraveling and tangling of the cords 14. FIG. 9 shows an earphone cord 14 received within the channel 22 of an earphone housing 12 and within the channel 28 of an earphone plug 16, such as to allow for wrapping of the cord 14 around a user's wrist, again preventing unraveling and tangling of the cords 14. In any of the embodiments and uses described above, the cord 14 may be dislodged from the channels 22, 28, 38 by a user with ease once the user wishes to use the earphones 10.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An earphone, comprising:

a housing arranged to receive a speaker, the housing having a front portion arranged to be inserted in a user's ear and a rear portion arranged to remain outside the user's ear, the front and rear portions aligned along a common horizontal axis, wherein the rear portion has a generally flat surface with a recessed channel formed therein, the channel sized to receive only one earphone cord and secure it therein, each end of the channel having an angled configuration with respect to the rear portion for facilitating insertion and removal of the earphone cord.

2. The earphone of claim 1, wherein the channel is oriented generally perpendicular to the horizontal axis.

3. The earphone of claim 1, wherein the channel has a generally circular cross-section.

4. The earphone of claim 1, wherein the earphone cord is secured in the channel via an interference fit.

5. The earphone of claim 1, wherein the rear portion has a hexagonal shape.

6. A pair of earphones, comprising:

a first housing and a second housing each arranged to receive a speaker, each of the first and second housings having a front portion arranged to be inserted in a user's ear and a rear portion which remains outside the user's ear;

a first earphone cord and a second earphone cord each having a first end extending from the first housing and the second housing, respectively; and an earphone plug for receiving a second end of each of the first and second earphone cords, the earphone plug having a plug housing with a recessed channel formed therein which is sized to removably receive only one of the first and second earphone cords and secure it therein, wherein the channel has an orientation generally parallel to the second ends of the first and second earphone cords as received at the earphone plug.

7. The pair of earphones of claim 6, wherein the rear portion has a channel formed therein which is sized to receive one of the first and second earphone cords and secure it therein.

8. The pair of earphones of claim 6, wherein the channel is formed in a protruding portion of the plug housing, the protruding portion configured as an upper portion of the plug housing having a larger cross-sectional area than a lower portion of the plug housing.

9. The pair of earphones of claim 6, wherein the plug housing has an angled configuration adjacent at least one end of the channel for facilitating insertion and removal of the earphone cord.

10. The pair of earphones of claim 6, wherein the channel has a generally circular cross-section.

11. The pair of earphones of claim 6, wherein the earphone cord is secured in the channel via an interference fit.

12. The pair of earphones of claim 6, further comprising a cord joint connected to the first and second earphone cords between the first and second housings and the earphone plug, the cord joint having a joint housing with a channel formed therein which is sized to receive one of the first and second earphone cords and secure it therein.

13. A pair of earphones, comprising:

a first housing and a second housing each arranged to receive a speaker therein, each of the first and second housings having a front portion arranged to be inserted in a user's ear and a rear portion arranged to remain outside the user's ear;

a first earphone cord and a separate second earphone cord extending from the first housing and the second housing, respectively; and a cord joint having a joint housing with a first end which receives the separate first and second earphone cords and an opposed second end, the separate first and second earphone cords terminating at the first end of the joint housing, the cord joint including a recessed channel formed therein which is sized to receive only one of the first and second earphone cords and secure it therein, the channel having a beveled configuration at the second end of the joint housing for facilitating insertion and removal of the earphone cord.

14. The pair of earphones of claim 13, wherein the rear portion has a channel formed therein which is sized to receive one of the first and second earphone cords and secure it therein.

15. The pair of earphones of claim 13, wherein the channel is formed in a side portion of the joint housing.

16. The pair of earphones of claim 13, wherein the channel has an orientation generally parallel to the earphone cord as received at the cord joint and has a generally circular cross-section.

17. The pair of earphones of claim 13, wherein the earphone cord is secured in the channel via an interference fit.

18. The pair of earphones of claim 13, further comprising an earphone plug connected to the cord joint, the earphone plug having a plug housing with a channel formed therein which is sized to receive one of the first and second earphone cords and secure it therein.

* * * * *